US005814176A

United States Patent [19]

Proulx

[11] Patent Number: 5,814,176

[45] Date of Patent: Sep. 29, 1998

[54] PROCESS FOR FORMING DOUBLE-STRAND MONOFILAMENT LINE FOR USE IN FLEXIBLE LINE TRIMMERS

[75] Inventor: Richard A. Proulx, Alta Loma, Calif.

[73] Assignee: Proulx Manufacturing, Inc., Rancho Cucamonga, Calif.

[21] Appl. No.: 597,178

[22] Filed: Feb. 6, 1996

[51] Int. Cl.[6] ..... A01D 50/00

[52] U.S. Cl. ..... 156/167; 156/180; 156/222; 156/244.11; 156/244.26; 156/498; 30/276; 30/347

[58] Field of Search ..... 30/347, 276; 156/166, 156/167, 244.11, 161, 180, 229, 244.24, 244.26, 433, 441, 494, 498

[56] References Cited

U.S. PATENT DOCUMENTS 3,690,978 9/1972 Nishizawa et al. ..... 156/167

4,282,653 8/1981 Comer et al. ..... 30/276

*Primary Examiner*—Michael W. Ball
*Assistant Examiner*—Michael A. Tolin
*Attorney, Agent, or Firm*—Lyon & Lyon LLP

[57] ABSTRACT

A process for forming flexible cutting line for use in rotary vegetation trimmers of the type having two or more monofilament lines mounted on a common spool. The line produced by the process of the present invention defines two monofilament strands joined together in a side by side relationship by a severable bond. The process includes the steps of extruding one or more pairs of molten monofilament strands in proximate disposition, directing the strands together in a cooling quench bath, pulling the strands in an adjacent abutting disposition through the quench bath to initiate the crystallization and bonding together of the two strands, concurrently stretching and heating the bonded strands to effect parallel alignment of the molecular chain in the strands, heating the strands in a relaxed disposition, wetting the strands and spooling the wetted strands for storage and transportation.

16 Claims, 4 Drawing Sheets

PROCESS FOR FORMING DOUBLE-STRAND MONOFILAMENT LINE FOR USE IN FLEXIBLE LINE TRIMMERS

BACKGROUND OF THE INVENTION

The present invention is directed to a process for forming flexible cutting line for use in rotary trimmers which is comprised of two monofilament strands joined by a severable bond. Flexible line rotary trimmers are used for cutting vegetation such as grass and weeds, particularly along walks, fences and flower beds and around trees. These devices comprise a motor driven rotary head which carries one or more lengths of monofilament line mounted on a spool within a housing. Extended end portions of each line project from the spool through guides in the side of the housing. As the head rotates at high speed, the end portions of the lines are caused to project outwardly from the housing by the centrifugal forces acting thereon and function as cutting blades. The majority of trimmer heads presently in use employ two separate monofilament nylon lines which are both mounted on a common spool and project from the spool and housing through diametrically opposed guides in the trimmer head housing.

The spool which carries the line is mounted within the housing such that it rotates with the housing during use but can be selectively rotated relative the housing to pay out additional line when the projecting end portions of the line become worn or severed. Because these heads typically employs two separate cutting lines, and occasionally three or four such lines, care must be taken in winding the lines about the common spool to prevent the lines from crossing over one another or otherwise tangling within the housing. If the lines become tangled within the housing, additional line cannot be payed out during use or even pulled from the head with out having to disassemble the head. This problem is particularly acute in fully automatic and bump-feed heads wherein even the slightest tangle can interfere with the proper indexing and paying out of the line. In addition to interfering with the proper line feeding mechanisms of the flexible trimmer heads, internal tangles can also cause balance and vibration problems which make the trimmer more difficult to use.

In an attempt to solve the problem of line tangle, efforts have been made to form a monofilament line comprised of two strands wherein the strands are secured together along their adjacent lengths by a suitable adhesive. The resulting double strand line is then simply wound about the spool and the end portions separated along their adhesive bond so that they can be fed out through the opposed guides. Bonding the two strands together in this manner along their entire lengths prevents tangling of the strands within the housing and, if the strands are properly joined, allows the strands to be readily separated for the feeding of new line through the opposed guides. This double-strand line, however, has been found to be excessively expensive to manufacture and the strength of the adhesive bond between the two strands can be inconsistent and cause premature separation of the strands. It would be highly desirable if such a dual-strand line could be provided which was economical to manufacture and wherein the bond joining strands together was continuous and of a uniform strength along its entire length. The process of the present invention provides such a line.

SUMMARY OF THE INVENTION

Briefly, the present invention comprises a process for forming one or more lengths of double-strand monofilament line which includes steps of extruding one or more pairs of molten monofilament strands, disposing the molten strands of each pair in an abutting side by side disposition and concurrently quenching the strands in cool water to initiate the crystallization and bonding together of the strands along a continuous weld to form a plurality of pairs of joined monofilament strands. The joined strands are concurrently heated and stretched to obtain the desired cross-sectional dimension and parallel molecular orientation and then reheated in a relaxed disposition. The formed double-strand lines are then quenched to enhance flexibility, toughness and impact resistance and separately spooled.

It is the principal object of the present invention to provide monofilament line for use in flexible line trimmer heads of the type employing two or more cutting lines which reduces line crossover and tangling within the trimmer head housing.

It is the another object of the present invention to provide a process for economically manufacturing a line comprised of two monofilament strands joined together in a side by side relationship along a readily severable bond for use in flexible line trimmer heads of the type employing two or more cutting lines.

These and other objects and advantages of the present invention will become readily apparent from the following detailed description of taken in conjunction with the accompanying drawings.

DESCRIPTION OF THE PREFERRED EMBODIMENT IN THE DRAWINGS

DESCRIPTION OF THE PREFERRED EMBODIMENT

Figures 1, 2:
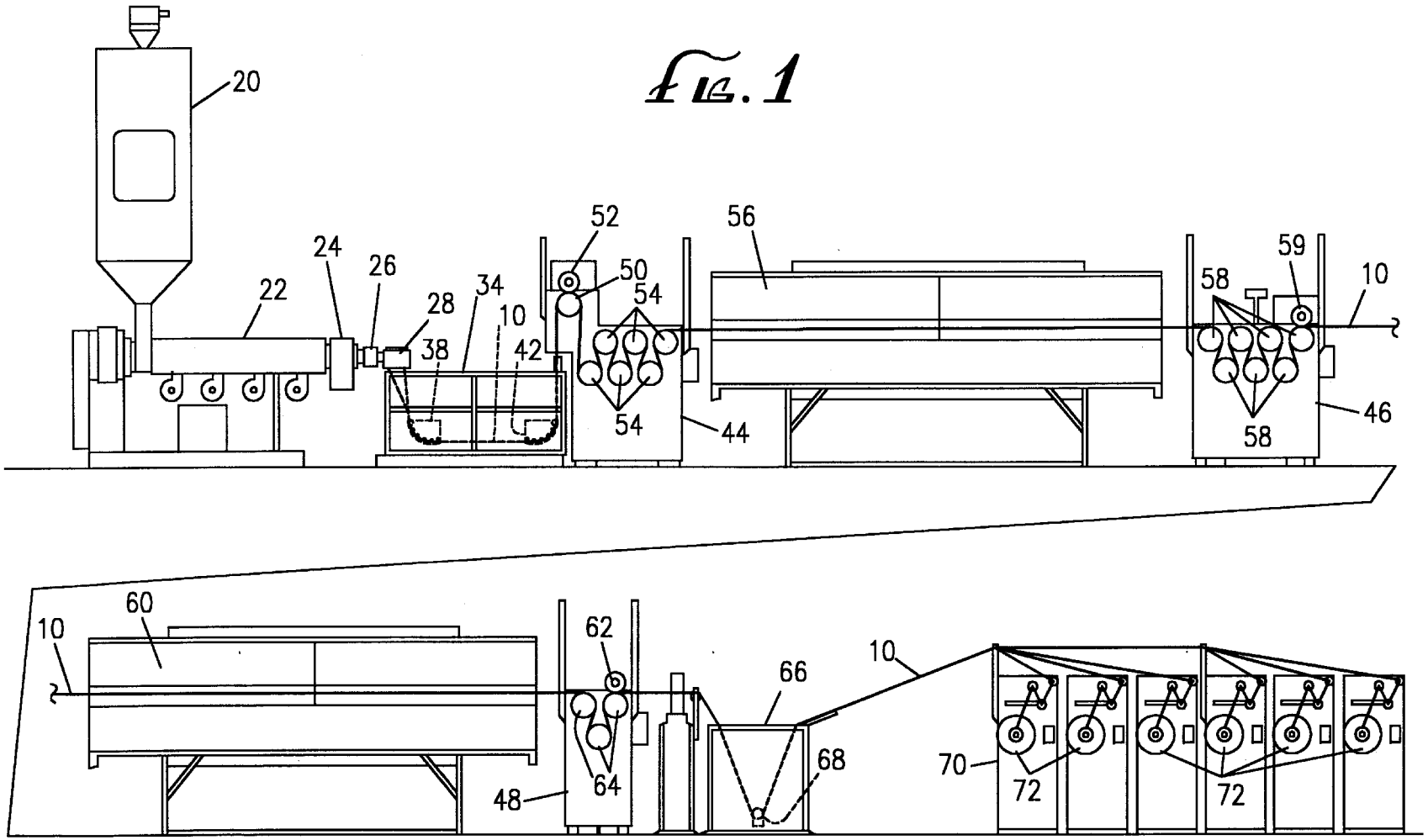
FIG. 1 is a schematic representation of a first portion of the manufacturing process of the present invention.
FIG. 2 is a schematic representation of the remainder of the manufacturing process of the present invention.
Figure 3:
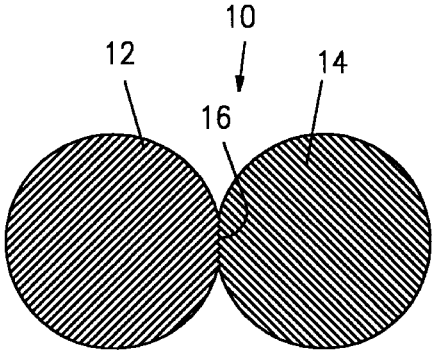
FIG. 3 is an enlarged cross-sectional view of a length of double-strand line formed in accordance with the present invention.
Figure 4:
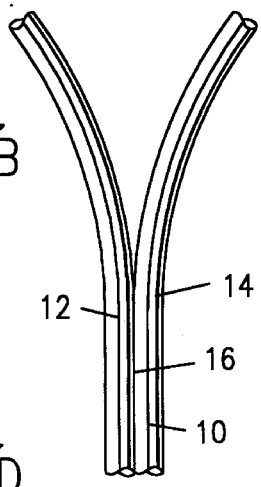
FIG. 4 is a perspective view of an end portion of a length of double-strand line formed in accordance with the present invention showing the end portion thereof being separated into its component strands for projection through opposed eyelets in the side wall of a rotary trimmer head housing.

Referring now in detail to the drawings, the process of the present invention is schematically represented in FIGS. 1 and 2. The result of the process is a double-strand monofilament line 10 comprised of a pair of monofilament strands 12 and 14 of constant diameter which are bonded together in a side by side relationship along a thin severable "weld" 16 as seen in FIG. 3. While weld 16 secures strands 12 and 14 together in parallel juxtaposition, it is readily severed by shearing forces. Thus, pulling the extended ends of strands 12 and 14 of line 10 in diverse directions will cause the strands to readily separate along the weld 16 as illustrated in FIG. 4. Accordingly, the double-strand line 10 can be easily wound about a trimmer head spool and stored thereon without risk of strand crossover or tangling due to the continual side by side securement of the component strands 12 and 14. Because the end portion of the line 10 can be readily separated by a shearing force into its component strands along a selected length, the two strands are easily separated and extended from the spool in opposed directions for insertion through opposed line guides or eyelets in the side wall of the trimmer head housing (not shown). The readily severable bond also allows the strands to be easily indexed through the opposed line guides in automatic feed and bump feed leads during use.

To obtain the aforesaid properties, line 10 is preferably constructed of a nylon copolymer material such as no. 8218 manufactured by Allied Signal, Inc. While other material compositions could be employed in carrying out the present invention, this material has been found to produce strong, durable and impact resistant cutting strands and a bonding weld having high tensile and low shear strength to provide the desired features discussed above. For line 10 comprised of strands having diameters up to about 0.080 in., a less expensive nylon homopolymer could be used such as no. 8219 by Allied Signal, Inc. Acceptable results can also be obtained at a lower cost in diameters over 0.080 in. by employing mixes of nylon copolymers and homopolymers. The use of the nylon copolymer material, without the addition of any homopolymer material, however, has been found to provide the strongest and most durable line.

In manufacturing the double-strand line 10 in accordance with the present invention, a supply of the nylon copolymer material is disposed in a hopper 20 and selectively fed through an extruder 22, a screen changer/filter assembly 24, a metering pump 26 and an extrusion die spin pack 28 disposed within pot 30. For each length of double-strand line 10 to be produced, die 28 defines a pair of spaced apertures 32. Examples of dies having different numbers of aperture pairs are shown in FIGS. 7A–7D. The extrusion die 28' illustrated in FIG. 7A will produce two lengths of double-strand monofilament line 10. Die 28" illustrated in FIG. 7B will produce three separate lengths of double strand line 10. Die 28"' illustrated in FIG. 7C will produce four separate lengths of line 10, etc. The particular location and/or orientation of each pair of apertures 32 in the extrusion die is not critical. It is, however, preferable to space each pair of apertures 32 substantially equidistantly apart on the die to minimize any inadvertent contact between the pairs of strands being extruded therethrough. The spacing between the two apertures 32 in each pair of apertures should be between 1/16 and 3/8 inch apart with the preferred spacing between apertures being 1/8 inch. As in the extrusion of single-strand monofilament line, the diameters of the individual apertures 32 in die 28 should be at least 50% greater than the desired final strand diameter. Examples of relative diameter sizes are shown in the following table.

| Strand Size (inch) | Pairs of Strands | Die Hole Size (inch) |
|---|---|---|
| .065 | 6 | .176 |
| .080 | 5 | .176 |
| .095 | 4 | .260 |
| .105 | 3 | .260 |
| .130 | 2 | .260 |

Variations in the strand size are obtained with a given diameter hole in the die, as seen above, by regulating the metering pump 26 and the line speed as in the manufacture of conventional single-strand monofilament line.

When the nylon polymeric material is extruded through the pairs of apertures 32 in extrusion die 28, a corresponding number of pairs of molten monofilament strands 12 and 14 are formed. Each pair of molten strands is directed downwardly from die 28 into a quench tank 34 filled with water which is maintained within the range of about 40° to 100° F., depending on the material being used, to effect crystallization of the nylon strands as they pass through the cooler water. If the line 10 is being constructed of the preferred nylon copolymer no. 8218 identified above, the water in tank 34 should be maintained within the range of 40° to 80° F. and preferably at about 60° to 80° F., with 60° F. being most preferable. If the line were being formed of a nylon homopolymer, the water temperature need not be quite as cool as nylon homopolymers crystalize more quickly. For example, if the aforesaid nylon homopolymer no. 8219 were being used, the water should be maintained from about 70° to 100° F., and more preferably at 80° to 90° F. A water cooling apparatus (not shown) is employed in tank 34 to maintain the water at the desired quenching temperature.

Figure 6:
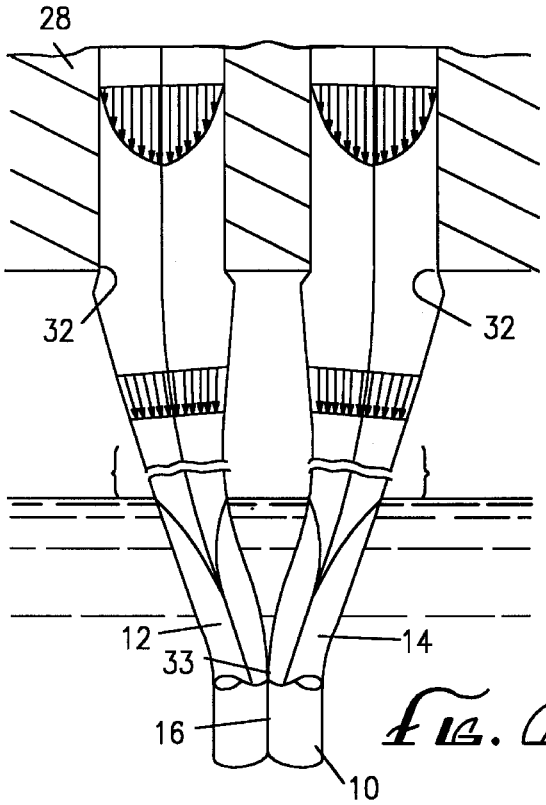
FIG. 6 is a further enlarged schematic representation of the initial forming and bonding together of a pair of monofilament strands in accordance with the present invention.
Figure 7A:
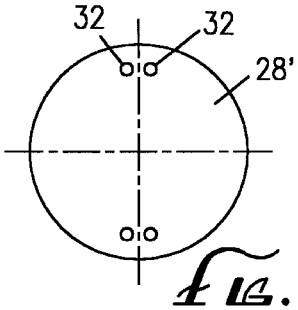
FIGS. 7A–7D are top plan views of extrusion dies for use in the process of the present invention illustrating different hole patterns for producing different quantities of double-strand monofilament lines.
Figure 7B:
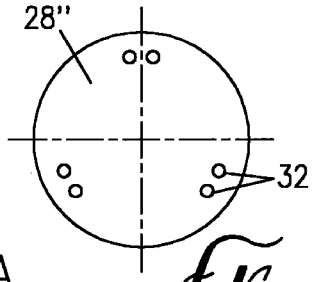
Figure 7C:
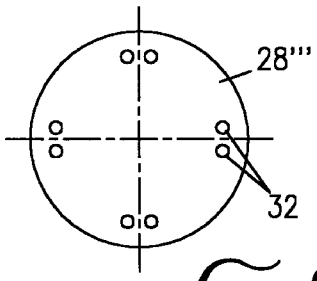
Figure 7D:
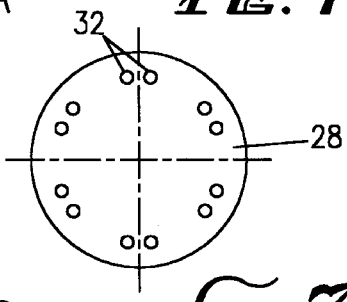

Within tank 34, the two extruded strands in each pair are initially pressed gently together below the surface of the water in the quench tank while the strands are still in a semi-molten state to initiate the formation of weld 16. The initial bonding together of two strands in the formation of a length of line 10 is illustrated in FIG. 6. The points at which the strands are initially pressed together and where the weld 16 will continue to form are identified by the numeral 33. The pairs of strands 12 and 14 are then directed in an adjacent side by side disposition about a series of rollers 35 which are mounted in a spaced curvilinear disposition in basket 38 adjustably mounted in the lower upstream end of the quench tank 34. The surface of the first roller 35' includes a plurality of raised annular ridges 36 which are spaced apart and define a series of finger guides for aligning the pairs of joined strands in a spaced parallel array. The guides could also be formed by a plurality of annular channels in the surface of roller 35'. The pairs of joined strands extend from carriage 38 in parallel alignment proximate the bottom of tank 34 and about a second plurality of rollers 39 mounted on a second basket 42. The last roller 39' on basket 42 is also preferably provided with a plurality of guides 40 similar to guides 36 on roller 35'. From basket 42, the pairs of strands are directed upwardly out of the quench tank 34, and through a sponge assembly 41 which strips excess water from the strands and is provided with a comb guide to maintain the alignment of the joined strands to a first roll stand 44. Roll stand 44 pulls the parallel array of the forming lengths of double-strand line 10 from the extrusion die 28 through the quench bath 34 and cooperates with a second roll stand 46 and a third roll stand 48 to move the lengths of line 10 through the forming process as will be explained.

As noted above, during the initial start-up of the line forming process, the two strands 12 and 14 in each length of line 10 being formed are physically pressed gently together at 33 to initiate the formation of the continuous weld 16. This is done manually and while points 33 are typically located about two to four inches below the surface of the water in tank 34, the precise spacing of the initial contact points 33 below the surface is not critical. Thereafter the finger guides 36 on roller 35' maintain each pair of joined crystallizing strands together as they pass thereover so that as roll stand 44 continually pulls the pairs of adjacent strands through the quench bath, the strands will continue to crystalize and the welds 16 will continue to form at points 33 and thus extend along and continuously bond together the pairs of strands 12 and 14 to form the lengths of double-strand line 10. Because the pairs of strands will continue to come together at points 33 and form continuous welds 16, it is only necessary to physically press the two strands together in the initial start-up of the forming process.

Figure 5:
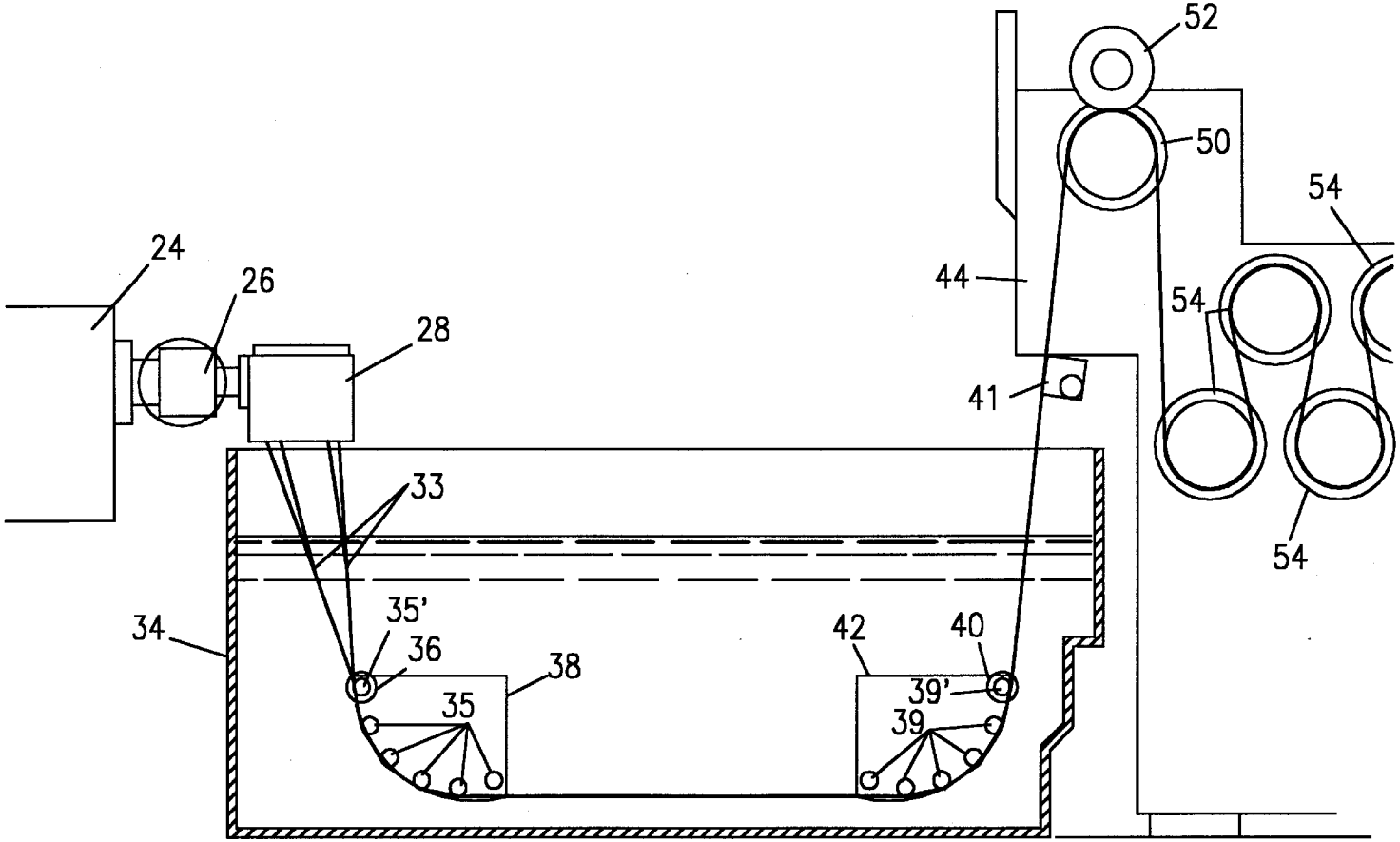
FIG. 5 is an enlarged schematic view of the filter assembly, metering pump, extrusion pot and first quench tank and illustrating the initial forming steps of double-strand monofilament line in accordance with the present invention.
Figure 8:
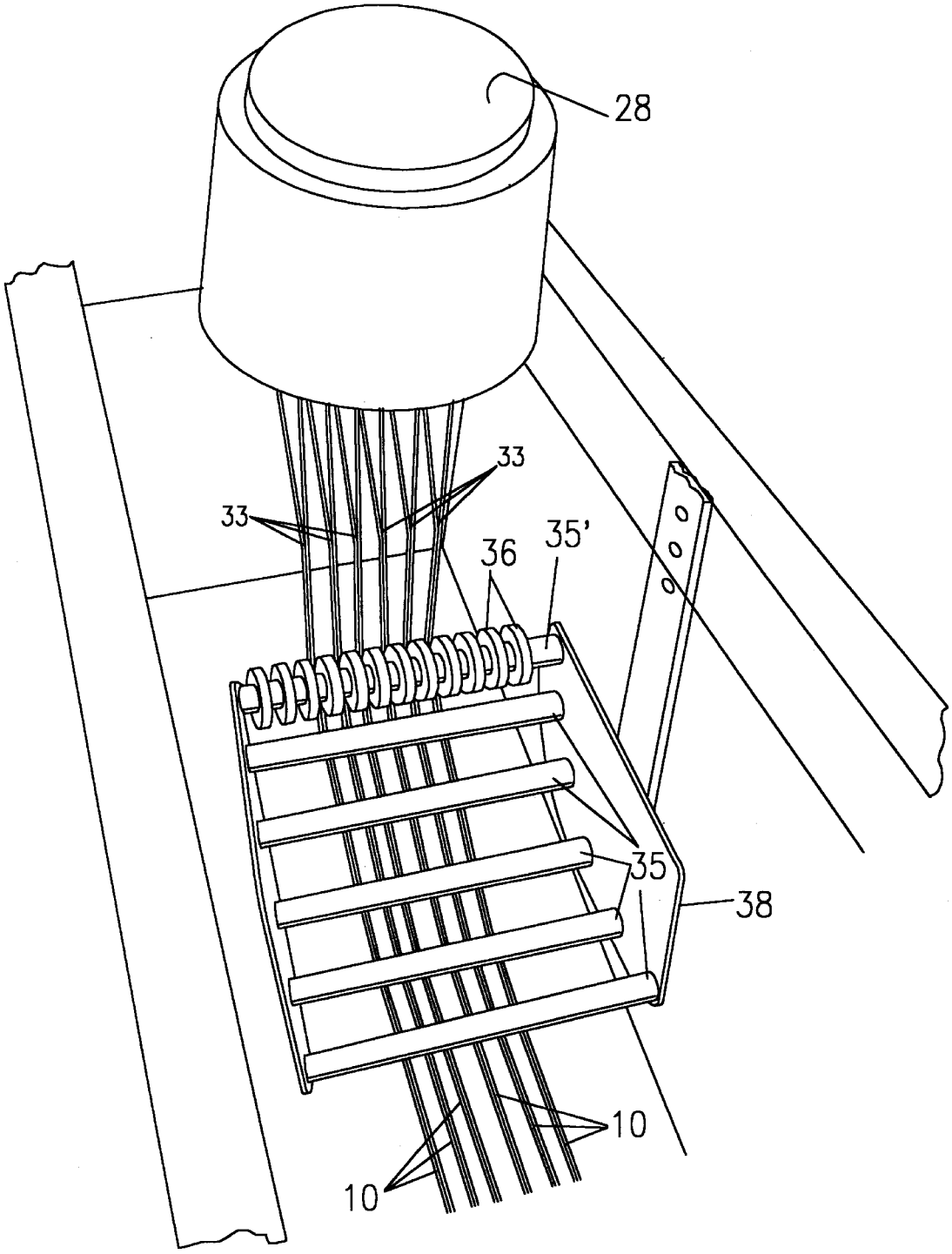
FIG. 8 is a perspective view of the upstream portion of the first quench tank showing the basket guide mounted therein for directing the lengths of double-strand line through the tank.

Roll stand 44 comprises an elevated drive roller 50 and a pinch roller 52 for pulling the joined strands upwardly from tank 34, and two rows of vertically and laterally spaced additional drive rollers 54 which cooperate with rollers 50 and 52 to pull the pairs of joined strands through the quench bath. The drive rollers in each of the three roll strands are preferably constructed with stainless steel outer surfaces, while the pinch rollers preferably have a hard rubber surface to provide the desired gripping and durability characteristics. As seen in FIGS. 1 and 5, the parallel array of spaced lines 10 extend from tank 34 between drive roller 50 and pinch roller 52, downwardly therefrom and about the two rows of drive rollers 54 and laterally therefrom into a first oven 56. The second roll stand 46 is disposed downstream of oven 56 and is comprised of two rows of vertically and laterally spaced drive rollers 58 and a pinch roller 59. Roll stand 46 pulls the parallel array of lines 10 from the first roll stand 44 and through oven 56.

To obtain the desired physical properties in line 10, it is important both to stretch the line while it is being heated in oven 56 and to obtain the desired degree of crystallization of the nylon polymer material prior to heating and stretching. Stretching the line during the heating step provides parallel orientation of the molecular structure within the two strands 12 and 14 of line 10 and is achieved by providing a differential between the rotational velocities of the drive rollers 50 and 54 in the first roll stand 44 and the drive rollers 58 in the second roll stand 46. All of the drive rollers in the three roll stands are preferably of the same size. Accordingly, by rotating the drive rollers 58 in the second roll stand 46 more rapidly than the drive rollers 50 and 54 in the first roll stand 44, the lines 10 are stretched as they are pulled through oven 56.

The amount of crystallization which occurs in the molten strands prior to heating and stretching is a function of the particular material being used, the temperature of the quench water and the quench time (time during which the line is submerged in the quench tank). The quench time depends on the velocity at which the lines are pulled through the tank and the length of underwater travel. From a commercial standpoint, it is desirable to maximize line output per unit time. This is preferably achieved in the present invention by extending the length of the quench tank 34 which allows the roll stands to operate at higher rotational velocities without decreasing quench time. It has also been found to be desirable to operate the roll stands at constant velocities and thus variations in the line material can be most easily accommodated by variations in the temperature of the quench water.

By way of example, five pair of double-strand lines 10 of the present invention have been formed of the aforesaid preferred nylon copolymer no. 8218 using a ten-hole die 28, wherein the strands 12 and 14 are 0.080 inch in diameter and the diameters of die holes 32 are each 0.176 inch. The water temperature in tank 34 is preferably 60° F. The vertical spacing between the lower face of the extrusion die 28 in pot 30 and the surfaces of the water in tank 34, which is referred to as the air gap, is 8 inches. As in the extrusion of single-strand monofilament line, the length of the air gap can vary from about 1 inch to 10 inches depending on the viscosity of the material used, the diameter of the strands being extruded and the draw-down ratios employed. The larger the diameter of the strands being formed and the less the draw-down ratio, the shorter the air gap. More viscous melts will require larger air gaps. The strand contact points 33 are about 2 to 4 inches below the surface of the water. The melt temperature is about 420° to 480° F. and the quench tank 34 is about six feet in length by three feet in depth. The rotational velocity of the drive rollers in the first roll stand 44 is 44.1 feet per minute. To provide the proper orientation of the molecular structure of the two stands in each length of line 10 so as to achieve the desired line strength and durability characteristics, oven 56 is maintained at about 580° F. and the ratio of the relative rotational speeds of the drive rollers 58 in the second roll stand 46 to the speed of the drive rollers 50 and 54 in the first roll stand 44 is about 3.1 to 1. Accordingly, the rotational speed of the drive rollers 50 and 54 in the second roll stand 46 in the present example is 136.71 feet per minute.

Orienting the strands by aforesaid stretching and heating places considerable stress on the strands. To provide the desired strength and durability in the final product, it is desirable to relieve this stress. This is accomplished in the present invention by subjecting the pairs of joined strands 12 and 14 to a second heating step. In the second heating step, however, the joined strands are in a relaxed state as opposed to being stretched during the first heating step. To provide the second heating step, a second oven 60 is disposed downstream of the second roll stand 46. The third roll stand 48 is positioned downstream of the second oven 60 to pull the lengths of line 10 through oven 60. Roll stand 48 preferably comprises a pinch roller 62 and three drive rollers 64 vertically and horizontally spaced apart as shown in FIG. 2. To pull the lines 10 through oven 62 in a relaxed state, the drive rollers of roll stand 48 are rotated at a rate about two to ten percent slower than the drive rollers 58 of the second roll stand 46. Thus, in the above example, rollers 58 would be driven at 133.97 feet per minutes. The second oven 60 is maintained at a slightly lower temperature than oven 56, preferably about 540° F.

A second quench tank 66 is disposed downstream of the third roll stand 48 to moisten the monofilament line prior to spooling as spooled line is inhibited from absorbing from moisture in the air which is desirable in freshly extruded nylon line from a strength standpoint. A suitable line guide 68 is provided in the lower portion of quench tank 66 to define an underwater path for the line through tank 66. The water in tank 66 is maintained at about the same temperature as the water in tank 34 to cool the formed line prior to spooling. Finally, a conventional spooling assembly 70 is deployed in the assembly line downstream of quench tank 66 wherein each of the individual double-strand lines 10 formed by the aforesaid process are individually wrapped about separate spools 72 for storage and shipment. In the example set forth above, five separate spools would be wound with line 10 by assembly 70 and a total of 199.5 pounds of line 10 would be produced per hour, based on 402 feet of line per pound.

In a second example, four pair of double-strand lines 10 of the same nylon copolymer have been formed using an eight-hole die 28, wherein the individual strands 12 and 14 are each 0.095 inch in diameter, the diameters of the die holes are each 0.260 inch. The melt temperature, water temperatures and oven temperatures are all the same as in the prior example. Because the line being formed is comprised of strands of greater diameter than the line in the prior example, the air gap is six inches. The initial strand contact points 33 are again 2 to 4 inches below the surface of the water. The rotational velocity of the drive rollers in the first roll stand 44 is 37.9 feet per minute. The velocity of the drive rollers in the second roll stand 46 is 117.49 fpm, and in the third roll stand is 115.14 fpm. In this example 200.97 pounds of line would be produced per hour at 275 feet per pound.

Various changes and modifications may be made in carrying out the present invention without departing from the spirit and scope thereof. Insofar as these changes and modifications are within the purview of the appended claims, they are to be considered as part of the present invention.

I claim:

1. A process for forming a flexible cutting line comprised of two monofilament strands joined together in a side-by-side disposition by a readily severable weld for use in rotary vegetation trimmers, said process comprising the following steps: extruding a pair of molten monofilament strands in proximate disposition; directing said molten strands in a spaced apart disposition into a cooling quench bath; then directing said strands into side-by-side parallel contact within said bath; pulling said strands in side-by-side parallel contact through the bath to effect crystallization and bonding together of the two strands; then concurrently stretching and heating the bonded strands; and then heating the bonded strands in a relaxed disposition.

2. The process of claim 1 including the additional steps of wetting the bonded strands and spooling the wetted strands.

3. The process of claim 1 wherein said stretching and heating step comprises pulling said strands from the quench bath at a first velocity; directing said strands from said quench bath to a heated oven; and pulling said strands through said oven at a second velocity, said second velocity being greater than said first velocity.

4. The process of claim 3 wherein said second velocity is about three times greater than said first velocity.

5. A process for forming a flexible cutting line comprised of two monofilament nylon polymer strands joined together in a side-by-side disposition by a readily severable weld for use in rotary vegetation trimmers, said process comprising the following steps: extruding at least one pair of molten monofilament nylon polymer strands in proximate disposition; directing said molten strands in a spaced apart disposition into a cooling quench bath; then directing said strands into side-by-side parallel contact within said bath; pulling said strands in side-by-side parallel contact through the bath at a first velocity to effect crystallization and bonding together of the two strands; then pulling the bonded strands through a heated oven at a second velocity, said second velocity being greater than said first velocity whereby said strands are heated and stretched within said oven; and then heating said strands in a second oven in a relaxed disposition.

6. The process of claim 5 including the additional steps of wetting the bonded strands and spooling the wetted strands.

7. The process of claim 6 wherein said second velocity is approximately three times said first velocity.

8. The process of claim 5 wherein said quench bath defines a temperature within the range of 60° to 80° F., said oven defines a temperature of about 580° F. and wherein said second velocity is about three times greater than said first velocity.

9. A process for forming a flexible cutting line comprised of two monofilament nylon polymer strands joined together in a side-by-side disposition by a severable weld for use in rotary vegetation trimmers, said process comprising the following steps: extruding a plurality of pairs of molten monofilament nylon polymer strands, the strands in each pair being in proximate disposition; directing said pairs of strands into a cooling quench bath; then directing said strands in each of said pairs into side-by-side parallel contact within said bath; pulling said pairs of side-by-side contacting strands through said bath for a time and at a first velocity so as to effect crystallization and bonding together of the strands in each of said pairs; then directing said bonded pairs of strands to a heated oven at said first velocity; pulling said strands through said oven at a second velocity, said second velocity being greater than said first velocity whereby said pairs of bonded strands are concurrently heated and stretched within said oven; pulling said heated and stretched pairs of strands through a second oven at a third velocity, said third velocity being greater than said first velocity and less than said second velocity whereby said pairs of strands are heated in a relaxed disposition; and collecting said pairs of bonded strands.

10. The process of claim 9 including the step of wetting said strands prior to said collecting step.

11. The process of claim 9 wherein said second velocity is about three times greater than said first velocity and said third velocity is about two to ten percent less than said second velocity.

12. The process of claim 9 wherein the water in said bath is at about 60° to 80° F., the temperature in said first oven is about 580° F. and the temperature in said second oven is about 540° F.

13. A process for forming a flexible cutting line comprised of two monofilament strands joined together in a side-by-side disposition by a readily severable weld for use in rotary vegetation trimmers, said process comprising the following steps: extruding a pair of molten monofilament strands in proximate disposition; directing said molten strands in a spaced apart disposition into a cooling quench bath; then directing said strands into side-by-side parallel contact within said bath; and pulling said strands in side-by-side parallel contact through the bath to effect crystallization and bonding together of the two strands.

14. A process for forming a flexible cutting line comprised of two monofilament nylon polymer strands joined together in a side-by-side disposition by a readily severable weld for use in rotary vegetation trimmers, said process comprising the following steps: extruding at least one pair of molten monofilament nylon polymer strands in a spaced apart disposition wherein the spacing between said strands in each pair is at least one sixteenth of an inch; directing said pair of molten strands in a spaced apart disposition into a cooling quench bath; then directing said strands into side-by-side parallel contact with said bath; pulling said pair of strands in side-by-side parallel contact through the bath to effect crystallization and bonding together of the pair of strands;

then concurrently stretching and heating the pair of bonded strands; and then heating the pair of bonded strands in a relaxed disposition.

15. The process of claim 13 wherein said stretching and heating step comprises pulling said pair of bonded strands from the quench bath at a first velocity, directing said pair of bonded strands from said quench bath to a heated oven at said first velocity; and pulling said strands through said oven at a second velocity, said second velocity being greater than said first velocity.

16. The process of claim 14 wherein said second velocity is about three times greater than said first velocity.

* * * * *